United States Patent [19]

Pollet

[11] 4,341,185

[45] Jul. 27, 1982

[54] FLUID-COOLED VALVE HOUSING FOR AN ENGINE HAVING TWO EXHAUST VALVES PER CYLINDER

[75] Inventor: Jean-Pierre Pollet, Arnouville les Gonesse, France

[73] Assignee: Societe d'Etudes de Machines Thermiques S.E.M.T., Saint-Denis, France

[21] Appl. No.: 100,245

[22] Filed: Dec. 4, 1979

[30] Foreign Application Priority Data

Jan. 29, 1979 [FR] France ..... 79 02192

[51] Int. Cl.[3] ..... F01P 3/14

[52] U.S. Cl. ..... 123/41.85; 123/188 GC; 123/189

[58] Field of Search ..... 123/41.31, 41.41, 41.76, 123/41.77, 41.85, 188 GC, 189, 41.17, 41.34, DIG. 1, DIG. 6, DIG. 7

[56] References Cited

U.S. PATENT DOCUMENTS

| | | | |
|---|---|---|---|
| 1,893,209 | 1/1933 | Parkhill | 123/189 |
| 4,000,730 | 1/1977 | Ottl et al. | 123/189 |
| 4,008,695 | 2/1977 | Bouquet | 123/188 GC |
| 4,200,066 | 4/1980 | Berchtold | 123/41.31 |

FOREIGN PATENT DOCUMENTS

| | | | |
|---|---|---|---|
| 158260 | 10/1978 | Netherlands | 123/188 GC |

*Primary Examiner*—Charles J. Myhre
*Assistant Examiner*—W. R. Wolfe
*Attorney, Agent, or Firm*—Kenyon & Kenyon

[57] ABSTRACT

A valve housing for an internal combustion engine having more than one intake or exhaust valve per cylinder includes complementary upper 14 and lower 16 members, with a transverse junction plane 17 intersecting a longitudinal partition 10 which divides an annular cavity 9 between a central valve bushing and a circumferential wall of the housing into separate coolant supply and return sections 9*a* and 9*b*, respectively. An intermediate element 17 is interposed between said members and is provided with openings 19, 20 smaller angular extents than the corresponding coolant sections to provide for proper circulation of coolant between the portions of a given section (9*a* or 9*b*) of cavity 9 while permitting different angular relations between said members.

22 Claims, 5 Drawing Figures

FLUID-COOLED VALVE HOUSING FOR AN ENGINE HAVING TWO EXHAUST VALVES PER CYLINDER

The present invention relates to a mushroom valve housing with fluid coolant circulation for an internal combustion engine.

The invention relates more particularly to a mushroom valve housing with fluid coolant circulation for an internal combustion engine comprising two exhaust valves per cylinder, and to a method of mounting such a housing.

There are already known mushroom valve housings with fluid coolant circulation for an internal combustion engine, which comprise a cage with a circumferential wall provided with a lateral orifice for connection with a gas admission or outlet passage into or from the cylinder on which the said housing is mounted, the said wall supporting at its lower end an annular valve seat containing an annular space for the said fluid coolant, and a central valve guide spaced from the wall by an annular cavity for the said fluid coolant, the cavity being subdivided by a longitudinal partition into two sections, namely, an intake section and a return section, for the said fluid coolant. Furthermore, at least two conduits are cut longitudinally in the wall to connect said cavity and the said space, respectively. Moreover, one of the said conduits leads to the bottom of one of the two sections, whereas the other conduit leads to the bottom of the other section, so as to ensure correct circulation of the fluid coolant.

However, when such housings are used in engines comprising two exhaust valves per cylinder and therefore two housings, namely, a right-hand housing and a left-hand housing, the angular position of the said lateral orifice of each right-hand or left-hand housing must be different so as to lead to a single outlet passage of the exhaust gases from the cylinder. In most cases, the upper portion, or valve guide portion, of the left-hand housing is a mirror image of the upper portion, or valve guide portion, of the right-hand housing, but the lower portion, or valve cage portion, of the left-hand housing can be identical to that of the right-hand housing provided the aforesaid orientation of the lateral orifice is observed.

The major drawback of the hitherto known valve housings is that the said orientation of the lateral orifice for connection with the outlet passage for the exhaust gases from the cylinder on which the said housing is mounted can be obtained only by using two foundry-made, differently shaped cage members, one of which is intended to be adapted to the valve guide portion of the left-hand housing and the other is intended to be adapted to the valve guide portion of the right-hand housing. Consequently, the cost of the housings finally obtained is relatively high.

The purpose of the present invention is to remedy the afore-mentioned drawback by providing a solution allowing the use of a single cage member adaptable to both the valve guide portion of the left-hand valve housing and that of the right-hand valve housing of an internal combustion engine provided with two exhaust valves per cylinder. This solution must preferably be of particularly simple design.

This solution consists, according to the invention, of a mushroom valve housing with fluid coolant circulation for an internal combustion engine, particularly an engine comprising two exhaust valves per cylinder, of the type described above, characterized in that it is constituted by at least two complementary members, namely, an upper member and a lower member, with the junction plane therebetween intersecting the said radial partitions, and in that it comprises an intermediate element interposed between the said upper member and the said lower member, the said element being provided with at least two openings allowing appropriate circulation of the fluid coolant between the upper and lower portions of a same section and having smaller angular extents than the corresponding sections so as to preclude any direct fluid coolant communication between the fluid coolant intake and return sections in at least two different angular positions of the said two members.

Such a valve housing structure allows the same lower member to be used for both the said left-hand housing and right-hand housing since the appropriate angular orientation of the said lateral orifice of each housing along the axis of the exhaust gas outlet passage from the cylinder can be obtained by simply rotating the lower member with respect to the upper member, the intermediate element ensuring correct circulation of the fluid coolant.

This allows important economy to be realized, compared with the prior art methods in which the lower or cage portion of the left-hand housing had a different shape from that of the lower or cage portion of the right-hand housing. Considerable reduction in housing production costs is therefore achieved.

According to a particularly advantageous form of embodiment, the intermediate element is substantially plane and is advantageously constituted by a disc, the two said openings of which extends along an arc of a circle smaller than 180°.

Advantageously, the said two openings are arranged substantially symmetrically with respect to the center of said intermediate element.

According to a preferred form of embodiment, each said opening extends along an arc of a circle between about 135° and 180°, thus allowing a shift of the respective angular positions of the two upper and lower members between 0° and 45° in either direction.

Specifically, in a right-hand housing for an engine comprising two exhaust valves per cylinder, namely, a left-hand exhaust valve and a right-hand exhaust valve, the lower member has an angular shift of about 22° to 25°, preferably 23.5°, with respect to the normal angular position of the lower member relative to the upper member without an intermediate element and in a corresponding left-hand housing, the lower member has an angular shift of about 40° to 43°, preferably 41.5°, with respect to the normal angular position of the lower member relatively to the upper member, without intermediate element.

It is thus seen that the valve housing according to the present invention offers great adaptability since the angular position of the lower member relative to the upper member, and therefore the angular position of the lateral orifice for connection with the exhaust gas outlet passage, can be varied within a range of from 0° to 45°, or more if desired. It should be pointed out, in this connection, that such valve housings are also suited to engines comprising two admission valves per cylinder, which engines also comprise left-hand and right-hand valve housings for each cylinder communicating with a single gas admission passage into the cylinder, which is particularly advantageous.

The invention also relates to engines provided with at least admission or exhaust valves per cylinder comprising two corresponding right-hand and left-hand housings, respectively, with a lateral orifice for connection with a single gas admission or outlet passage into or from the said cylinder, characterized in that the said valve housings are constituted by housings according to the invention as defined in the foregoing, whose left-hand and right-hand upper members, respectively, are mirror images of each other, whereas the lower member of the left-hand housing is identical with that of the right-hand housing.

Advantageously and as mentioned above, the lower member of the right-hand housing has an angular shift of from 22° to 25°, preferably 23.5°, with respect to the normal angular position of the lower member relative to the upper member, without intermediate element, and, likewise, the left-hand housing is angularly shifted by about 40° to 43°, preferably 41.5°.

Lastly, the present invention relates to a method of mounting a valve housing according to the invention, characterized by securing, e.g. by welding or soldering, the intermediate element to one of the afore-mentioned upper or lower members in such a manner that each opening is located on either side of the plane of the longitudinal partition of the cavity of the said member, and then in securing, e.g. by welding or soldering, the other of said upper or lower member to the assembly comprising the intermediate element and the upper or lower member, with a predetermined angular shift between 0° and 45° with respect to the normal position of the said members without intermediate element.

Other purposes, characterizing features and advantages of the invention will appear more clearly from the following explanatory description made with reference to the appended drawings illustrating one presently preferred form of embodiment of a valve housing according to the invention, given solely by way of example and wherein.

Figure 1:
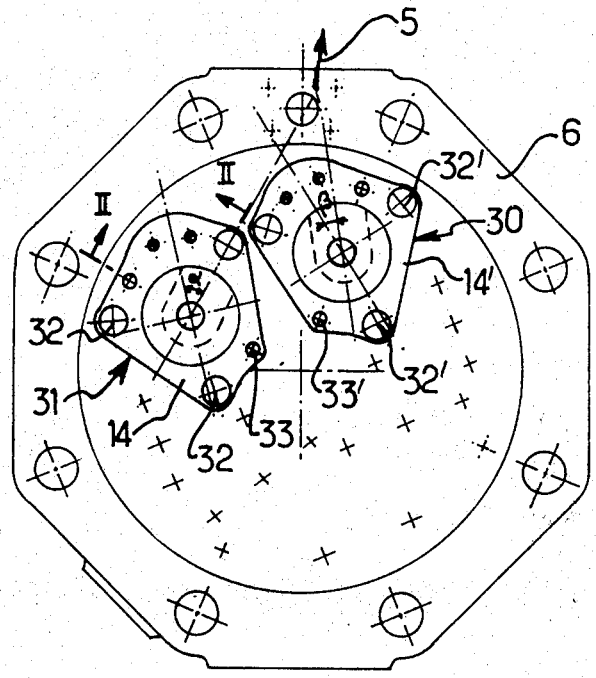
FIG. 1 is a cross-sectional view of an engine cylinder provided with two exhaust valves and therefore two exhaust valve housings according to the invention, the lateral orifices of which open into a single exhaust gas outlet passage, the said cross-section being made at the valve housings and the valves being removed for the sake of clarity.
Figure 5:
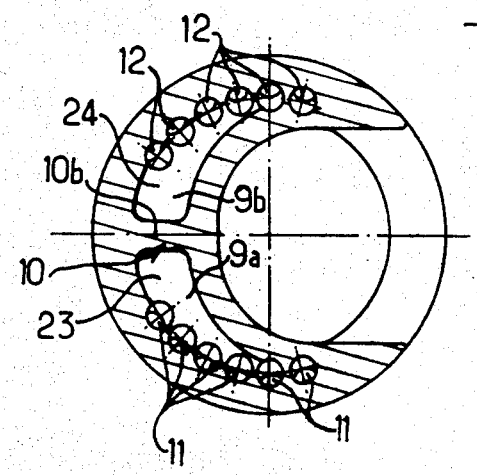
FIG. 5 is a sectional view upon the line V—V of FIG. 2.
Figure 2:
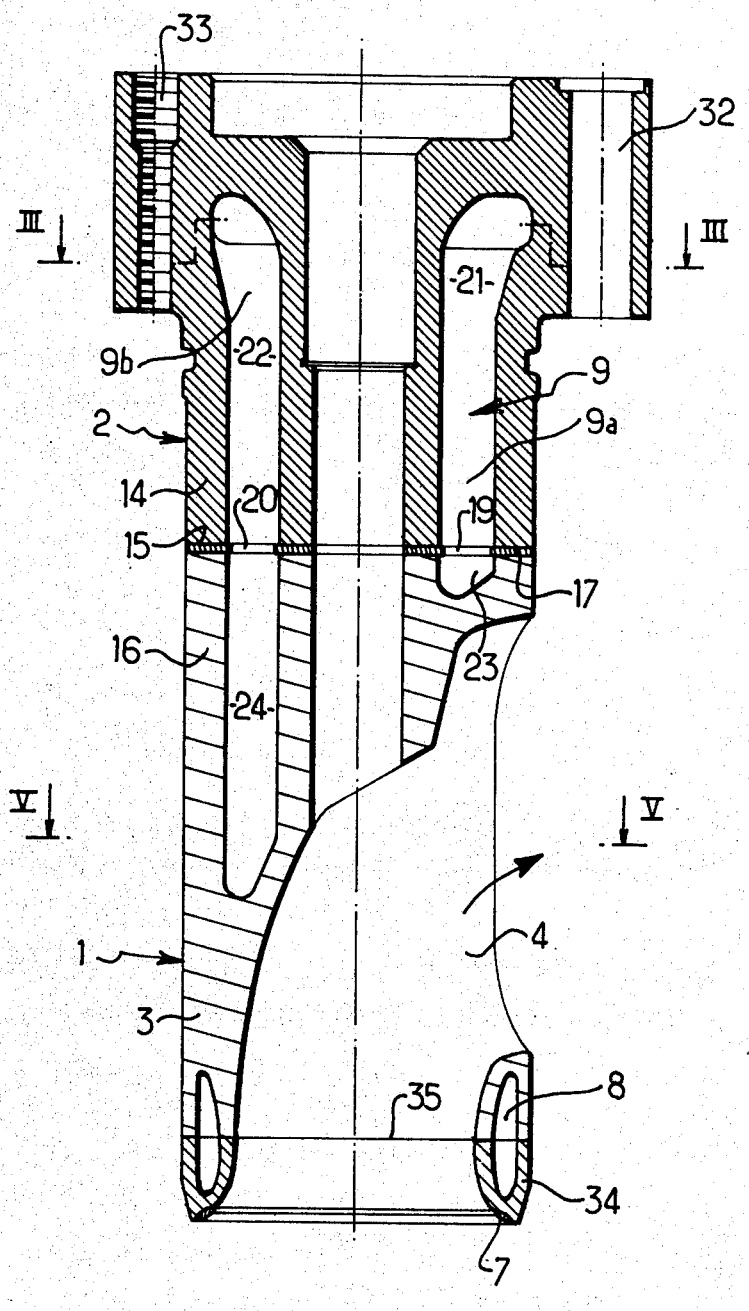
FIG. 2 is a sectional view upon the broken line II—II of FIG. 1.

Referring to FIGS. 1 to 5 and more particularly to FIG. 2, the mushroom valve housing with fluid cooling circulation for an internal combustion engine comprises a cage 1 and a valve guide 2. In order to facilitate the understanding of the drawing, the valve fitted by its stem into the housing is not shown.

The cage 1 comprises a circumferential wall 3 provided with a lateral orifice 4 for connection to a gas admission or outlet passage 5 (see FIG. 1) into or from the cylinder 6 on which the housing is mounted. The wall 3 supports at its lower end an annular valve seat 7 containing an annular space 8 for the fluid coolant. The valve guide 2 has an annular cavity 9 for the fluid coolant subdivided by a longitudinal partition 10 (see FIGS. 3 and 5) into two sections, namely, a fluid coolant intake section 9*a* and a fluid coolant return section 9*b*.

At least two conduits, such as 11, 12 (FIG. 5), connect the cavity 9 and the space 8, respectively. One conduit 11 leads from the space 8 to the bottom of section 9a whereas the other conduit 12 leads to the bottom of the other section 9b.

The valve guide 2 and the cage 1 form two complementary members of the valve housing, namely, an upper member 14 and a lower member 16, with a transverse junction plane 15 therebetween intersecting the longitudinal partition 10 into an upper partition portion 10a and a lower partition portion 10b. An intermediate element 17 is interposed between the upper member 14 and the lower member 16. The intermediate element 17 is provided with at least two openings 19 and 20, as seen clearly in FIG. 3, allowing for proper circulation of the fluid coolant between the upper portions 21-22 22 and the lower portions 23,24 of of the respective sections 9*a*, 9*b*. The openings 19, 20 have smaller angular extents than the respective sections 9*a*, 9*b* to preclude any direct communication between the fluid coolant intake section 9*a* and the fluid coolant return section 9*b* in at least two different angular positions of the said two members, as seen clearly in FIGS. 3 and 4.

Figure 3:
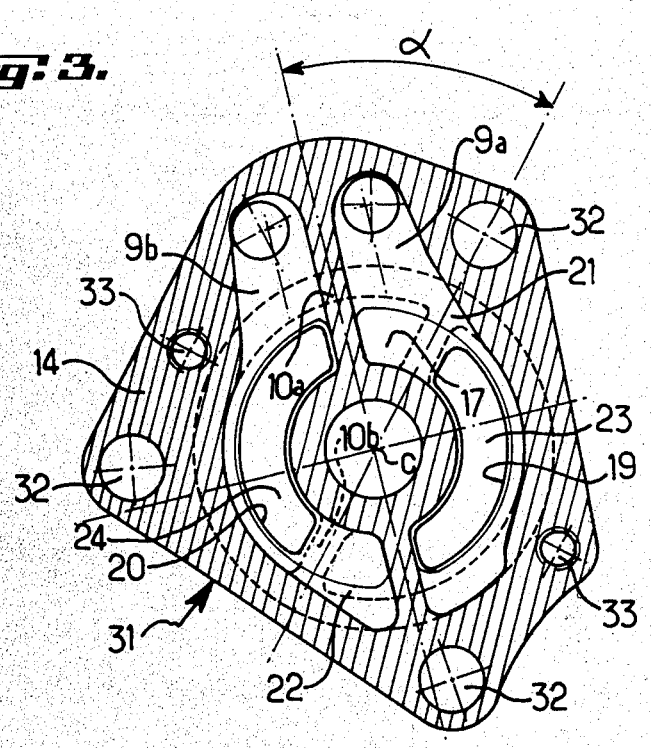
FIG. 3 is a sectional view upon the line III—III of FIG. 2.
Figure 4:
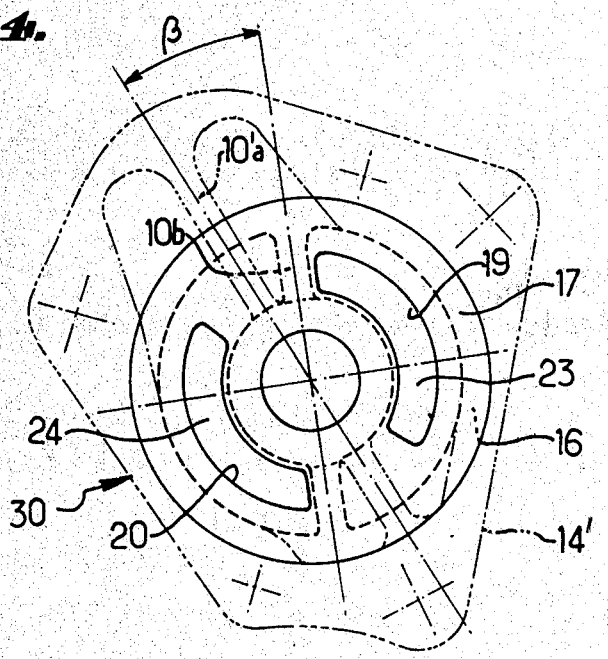
FIG. 4 is a sectional view similar to that of FIG. 3, showing the right-hand valve housing, the position of the upper member of the said housing being shown in phantom lines.

Preferably the intermediate element is substantially plane and is advantageously constituted by a disc the two openings 19, 20 of which subtend a circular arc smaller than 180°, as seen clearly in FIGS. 3 and 4.

According to a particularly advantageous form of embodiment, the two openings 19, 20 are arranged substantially symmetrically with respect to the center C (FIG. 3) of the intermediate element 17.

Advantageously, each opening 19, 20 extends along an arc of a circle comprised between about 135° and 180°, thus allowing a shift ($\alpha$ FIG. 3; or $\beta$ FIG. 4) of the respective angular positions of the upper members 14 and 16, respectively, comprised between 0° and 45°.

If the valve housing according to the invention is intended to form the right hand valve housing 30 of an engine comprising two exhaust valves per cylinder is, namely, a left-hand exhaust valve and a right-hand exhaust valve, and therefore two valve housings 30, 31, the lower member 16 advantageously has an angular shift $\beta$ (see FIG. 4) of about 22° to 25°, preferably 23.5° (as shown) with respect to the normal angular position of the lower member 16 relative to the upper member 14 without intermediate element.

Likewise, if the valve housing according to the invention is intended to form the left-hand valve housing 31 of such an engine with two exhaust valves per cylinder, the lower member 16 advantageously has an angular shift ($\alpha$, FIG. 3) of about 40° to 43°, preferably 41.5° (as shown) with respect to the normal angular position of the lower member 16 relative to the upper member 14, without intermediate dement 17.

The valve housings according to the invention therefore find their main application in engines having two admission or exhaust valves per cylinder 6 (FIG. 1) comprising corresponding right-hand and left-hand valve housings 30 and 31, respectively, with a lateral orifice such as 4 for connection to a single gas admission or outlet (in the case illustrated) passage 5 into or from the cylinder. In this case, the valve housings 30, 31 are constituted by housings according to the invention whose left-hand and right-hand upper members 14 and 14', respectively, are mirror images of each other, whereas the lower member 16 of the left-hand housing is identical to that of the right-hand housing.

It should be noted that in FIG. 4 the same reference numerals as those of the upper portion 14 of the left hand housing 31 are used in the upper portion 14' of the right-hand housing 30 together with the distinguishing sign prime. For example, the longitudinal partition of the upper portion 14' is denoted by 10*a'* and corresponds to the portion 10*a* (FIG. 3).

The invention therefore allows a same lower member 16 or cage 1 to be used for either the left-hand housing or the right-hand housing, thus permitting valve housing production costs to be reduced by allowing greater standardization of the required castings. Another advantage of such design is that such valve housings offer greater adaptability, since the angular position of the lower member 16 relative to the upper member 14 can be varied within a wide range of from 0° to 45° or more, in each direction.

Of course the upper member 14, the intermediate element 17 and the lower member 16 in the assembled condition are interconnected invariably, e.g. by welding or soldering, in a manner known per se. Each valve housing is thereafter mounted on a cylinder 6 (FIG. 1) by using means such as 32, 33; 32', 33' for properly securing them in the cylinder head.

The invention also relates to a method of assembling the afore-mentioned valve housing, characterized in that it comprises securing, e.g. by welding or soldering, the intermediate element 17 to one of the aforesaid upper member 14 or lower member 16 in such a manner that each opening 19, 20 is arranged on either side of the plane of the longitudinal partition 10 of the cavity 9 of the said member, and then in securing, e.g. by welding or soldering, the other of said upper member 14 or lower member 16, to the assembly formed of the intermediate element 17 and the upper member or the lower member (the lower member 16 in the case illustrated), with a predetermined angular shift ($\alpha$, FIG. 3; $\beta$, FIG. 4) between 0° and 45° in the illustrated embodiment with respect to the normal position of the said upper member 14 and lower member 16 without intermediate element 17.

Of course the shift by an angle $\alpha$ of the partition 10 between the upper member 14 and the lower member 16 of the left-hand housing 31 causes an identical shift of the position of the lateral orifice, thus allowing this lateral orifice 4 to be directed along a axis 5*a* of the exhaust gas outlet passage 5 from the cylinder 6 on which the valve housing is mounted, as shown in FIG. 1.

Similarly, for the right-hand housing 30, the angular shift $\beta$ directs the lateral orifice 4 along an axis 5*b* of the exhaust gas outlet passage 5.

It should be noted that the above-described valve housing is capable of various modifications. For example, the annular space 8 may be formed by securing a separate part 34 to the wall 3 at a transverse junction plane 35 in order to facilitate the construction of the valve housing.

Therefore, the invention is by no means limited to the form of embodiment described and illustrated which has been given by way of example only. In particular, it comprises all means constituting technical equivalents to the means described as well as their combinations should the latter be carried out according to its gist and within the scope of the following claims.

What is claimed is:

1. An internal combustion engine having a cylinder, a right-hand and a left-hand valve for said cylinder, and respective right-hand and left-hand fluid-cooled valve housing assemblies for said valves, each housing assembly including a cage member having a circumferential outer wall with a lateral opening in the wall connecting to a common passage of the cylinder, and an annular valve seat portion at one end of the cage member having an annular space for fluid coolant therein, a valve guide member at the other end of the cage member, said valve guide member having axially extending circumferentially spaced coolant supply and coolant return compartments connecting to the annular space in the valve seat portion through coolant supply and return passages provided within the cage member, and an intermediate element interposed between the valve guide member and the cage member, the intermediate element having one opening for coolant flow between the supply compartment of the valve guide member and the supply passage of the cage member and another opening for coolant flow between the return passage of the cage member and the return compartment of the valve guide member, wherein the improvement comprises:

said cage member being provided with at least one portion of said coolant supply and coolant return compartments, said intermediate element thereby dividing the coolant supply and coolant return compartments into upper coolant supply and coolant return compartment portions in the valve guide member and lower coolant supply and coolant return compartment portions in the cage member;

the angular extents of the one and the other openings in the intermediate element being less than the angular extents of the supply and return compartment portions, respectively, in the valve guide member and the cage member adjacent to the intermediate element;

the upper supply and return compartment portions in the valve guide member being angularly shifted relative to the lower supply and return compartment portions of the cage member, with direct communication between the supply compartment portion of one of said members and the return compartment portion of the other of said members being precluded by said intermediate element;

the valve guide member of the right-hand housing being a mirror image of the valve guide member of the left-hand housing; and the cage member of the right-hand housing being identical to the cage member of the left-hand housing.

2. The engine of claim 1, wherein the angular shift of the upper supply and return compartment portions of the valve guide member with respect to the lower supply and return compartment portions of the cage member for the right-hand valve housing is about 22° to 25°, and the corresponding angular shift for the left-hand valve housing is about 40° to 43°.

3. A fluid cooled housing assembly for a mushroom valve of an internal combustion engine, the housing assembly including a cage member having a circumferential outer wall with a lateral opening in the wall for connection to a common passage of an engine cylinder, and an annular valve seat portion at one end of the cage member and having an annular space for fluid coolant therein, a valve guide member at the other end of the cage member, said valve guide member having axially extending circumferentially spaced coolant supply and coolant return compartments connecting to the annular space in the valve seat portion through respective coolant supply and coolant return passages provided within the cage member, and an intermediate element interposed between the cage member and the valve guide member, the intermediate element having one opening for coolant flow between the supply compartment of the valve guide member and the supply passage of the cage member and another opening for coolant flow between the return passage of the cage member and the return compartment of the valve guide member, wherein the improvement comprises:

both said valve guide member and said cage member being provided with said axially extending circumferentially spaced coolant supply and coolant return compartments so that said intermediate element divides each compartment into an upper and a lower compartment portion, and the angular extents of the one and the other openings in the intermediate element being less than the angular extents of the supply and return compartments, respectively, in the valve guide member and the cage member adjacent to the intermediate element.

4. The valve housing of claim 3, wherein the intermediate element is substantially planar.

5. The valve housing of claim 3, wherein the angular shift of the upper supply and return compartment portions of the valve guide member with respect to the lower supply and return compartment portions of the cage member is about 22° to 25°, said valve housing being adapted to be the right-hand exhaust valve housing of an engine cylinder having at least two exhaust valves.

6. The valve housing of claim 5, wherein said angular shift is 23.5°.

7. The valve housing of claim 3, wherein the angular shift of the upper supply and return compartment portions of the valve guide member with respect to the lower supply and return compartment portions of the cage member is about 40° to 43°, said valve housing being adapted to be the left-hand exhaust valve housing of an engine cylinder having at least two exhaust valves.

8. The valve housing of claim 7, wherein said angular shift is 41.5°.

9. The valve housing of claim 3, wherein the intermediate element comprises a disc in which each of said supply and return openings extends along a circular arc smaller than 180°.

10. The valve housing of claim 9, wherein the supply and return openings in said disc are arranged substantially symmetrically with respect to the center of the disc.

11. The valve housing of claim 10, wherein each of the supply and return compartments in both the valve guide member and the cage member extends over a circular arc of almost 180°, and each of the supply and return openings in said disc extends over a circular arc of at least approximately 135°, thereby allowing an angular shift of the upper supply and return compartment portions of the valve guide member relative to the lower supply and return compartment portions of the cage member of up to about 45° in either direction.

12. A fluid-cooled housing assembly for a mushroom valve of an internal combustion engine having more than one valve per cylinder connected to a common passage, the housing assembly including a cage member having a circumferential outer wall with a lateral opening in the wall for connection to a common passage of an engine cylinder, and an annular valve seat portion at one end of the cage member and having an annular space for fluid coolant therein, a valve guide member at the other end of the cage member, said valve guide member having axially extending circumferentially spaced coolant supply and coolant return compartments connecting to the annular space in the valve seat portion through coolant supply and return passages provided within the cage member, and an intermediate element interposed between the valve guide member and the cage member, the intermediate element having one opening for coolant flow between the supply compartment of the valve guide member and the supply passage of the cage member and another opening for coolant flow between the return passage of the cage member and the return compartment of the valve guide member, wherein the improvement comprises:

at least a portion of the said coolant supply and coolant return compartments being provided within said cage member, the intermediate element thereby dividing each coolant supply and coolant return compartment respectively into upper coolant supply and coolant return compartment portions in the valve guide member and lower coolant supply and coolant return compartment portions in the cage member adjacent to the intermediate element;

the angular extents of the one and the other openings in the intermediate element being less than the angular extents of the supply and return compartment portions, respectively, in the valve guide member and the cage member adjacent to the intermediate element; and the upper supply and return compartment portions in the valve guide member being angularly shifted relative to the lower supply and return compartment portions of the cage member, with direct communication between the supply compartment portion of one of said members and the return compartment portion of the other of said members being precluded by said intermediate element.

13. The valve housing of claim 12, wherein the intermediate element is substantially planar.

14. The valve housing of claim 12, wherein the angular shift of the upper supply and return compartment portions of the valve guide member with respect to the lower supply and return compartment portions of the cage member is about 22° to 25°, said valve housing being thereby adapted to be the right-hand exhaust valve housing of an engine cylinder having two exhaust valves at least.

15. The valve housing of claim 14, wherein said angular shift is 23.5°.

16. The valve housing of claim 12, wherein the angular shift of the upper supply and return compartment portions of the valve guide member with respect to the lower supply and return compartment portions of the cage member is about 40° to 43°, said valve housing being thereby adapted to be the left-hand exhaust valve housing of an engine cylinder having at least two exhaust valves.

17. The valve housing of claim 16, wherein said angular shift is 41.5°.

18. The valve housing of claim 12, wherein the intermediate element comprises a disc in which each of said supply and return openings extends along a circular arc smaller than 180°.

19. The valve housing of claim 18, wherein the supply and return openings in said disc are arranged substantially symmetrically with respect to the center of the disc.

20. The valve housing of claim 19, wherein each of the supply and return compartment portions in both the valve guide member and the cage member extends over a circular arc of almost 180°, and each of the supply and return openings in said disc extends over a circular arc of at least approximately 135°, thereby allowing an angular shift of the upper supply and return compartment portions of the valve guide member relative to the lower supply and return compartment portions of the cage member of up to about 45° in either direction.

21. A method of assembling a mushroom valve housing having a valve guide member with a cylindrical outer wall surrounding an annular space subdivided by a partition into axially extending supply and return compartments for fluid coolant, a cage member with a circumferential outer wall surrounding supply and return passages corresponding to those of the valve guide member, and an intermediate element interposed between the guide member and the cage member and having openings corresponding to the supply and return compartments of the valve guide member and the cage member, the circumferential extent of each of said openings subtending a smaller angle than said corresponding supply and return compartments, the method comprising:

securing the intermediate element coaxially to one of the valve guide member and cage member of the housing, with each of said openings angularly located on the corresponding supply or return compartment side of said partition in the one member, and then securing the other of said valve guide and cage members coaxially to the intermediate element, with each opening of the intermediate element also located on the corresponding supply or return compartment side of the partition of the other member, but with an angular shift between the supply and return compartments of the other member relative to the respective supply and return compartments of the one member.

22. The method of claim 21, wherein the amount of said angular shift is up to 45°.

* * * * *

UNITED STATES PATENT AND TRADEMARK OFFICE

CERTIFICATE OF CORRECTION

PATENT NO. : 4,341,185

DATED : 27, July 1982

INVENTOR(S) : Jean-Pierre POLLET

It is certified that error appears in the above—identified patent and that said Letters Patent is hereby corrected as shown below:

In the Abstract: line 12, after "of" insert --the--.

Column 3, line 4: after "least" insert --two--.

Column 3, line 5: delete "two".

Column 4, line 22: delete "21-22 22" and insert --21, 22--.

Column 4, line 23: delete "of" first occurrence.

Column 4, line 45: delete "is" and insert --6--.

Column 4, line 60: delete "dement" and insert --element--.

Signed and Sealed this

*Twenty-sixth* Day of *October 1982*

[SEAL]

*Attest:*

*Attesting Officer*

GERALD J. MOSSINGHOFF

*Commissioner of Patents and Trademarks*